US005845225A

United States Patent [19]

Mosher

[11] Patent Number: 5,845,225

[45] Date of Patent: Dec. 1, 1998

[54] MICROCOMPUTER CONTROLLED ENGINE CLEANING SYSTEM

[76] Inventor: Frederick A. Mosher, 3449 Summerset Cir., Costa Mesa, Calif. 92626

[21] Appl. No.: 415,609

[22] Filed: Apr. 3, 1995

[51] Int. Cl.[6] ..... F02B 77/00; B08B 3/00

[52] U.S. Cl. ..... 701/102; 701/103; 123/198 A; 134/56 R; 134/169 A

[58] Field of Search ..... 364/431.01, 431.05, 364/431.06, 431.03, 431.04; 60/274, 286, 289, 301, 303, 276, 290; 134/10, 18, 169 A, 169 R, 111, 56 R, 57 R, 113, 166 C, 167 R, 172, 22.11, 22.12; 123/196 A, 196 R, 198 D, 198 A, 25 M, 25 F, 409, 568, 520; 423/239.1, 235, 244.09; 141/21, 92, 83, 59, 65

[56] References Cited

U.S. PATENT DOCUMENTS

| | | | |
|---|---|---|---|
| 1,780,605 | 11/1930 | Spinney | 141/21 |
| 1,820,552 | 8/1931 | Wooley | 134/111 X |
| 2,784,747 | 3/1957 | Weempe | 141/21 |
| 2,912,990 | 11/1959 | Wilson | 134/169 A |
| 3,094,131 | 6/1963 | Williams | 134/169 A |
| 3,531,323 | 9/1970 | Carpenter et al. | 134/169 R |
| 3,979,906 | 9/1976 | Staggs | 60/310 |
| 4,086,930 | 5/1978 | Hiss | 134/169 A |
| 4,167,193 | 9/1979 | Magnus et al. | 134/95.2 |
| 4,276,914 | 7/1981 | Albertson | 123/41.42 |
| 4,378,034 | 3/1983 | Albertson | 141/1 |
| 4,492,113 | 1/1985 | Weatherholt | 73/40 |
| 4,793,386 | 12/1988 | Sloan | 141/65 |
| 4,877,043 | 10/1989 | Carmichael et al. | 134/169 A |
| 4,989,561 | 2/1991 | Hein et al. | 123/198 A |
| 4,991,608 | 2/1991 | Scweiger | 134/169 A |
| 5,090,433 | 2/1992 | Kamaga | 134/169 C |
| 5,147,610 | 9/1992 | Watanabe et al. | 134/166 R |
| 5,184,585 | 2/1993 | Wilson | 123/179.8 |
| 5,197,500 | 3/1993 | Diamond | 134/142 |
| 5,232,513 | 8/1993 | Suratt et al. | 134/21 |
| 5,257,604 | 11/1993 | Vataru et al. | 123/198 A |
| 5,287,834 | 2/1994 | Flynn | 123/198 A |
| 5,313,925 | 5/1994 | Otsuka et al. | 123/520 |
| 5,362,265 | 11/1994 | Gervais | 440/88 |
| 5,381,810 | 1/1995 | Mosher | 123/198 A |
| 5,431,893 | 7/1995 | Hug et al. | 423/234.1 |
| 5,452,696 | 9/1995 | Flynn | 123/198 A |
| 5,460,656 | 10/1995 | Waelput et al. | 134/10 |
| 5,479,902 | 1/1996 | Wilbeleit et al. | 123/498 |
| 5,503,683 | 4/1996 | Butcher et al. | 134/22.12 |
| 5,522,218 | 6/1996 | Lane et al. | 60/274 |
| 5,624,239 | 4/1997 | Osika | 417/187 |

FOREIGN PATENT DOCUMENTS 860854 2/1961 United Kingdom .

*Primary Examiner*—Jacques H. Louis-Jacques
*Attorney, Agent, or Firm*—Knobbe, Martens, Olson & Bear, LLP

[57] ABSTRACT

An electronically controlled carbon-cleaning apparatus for removal of carbon deposits in internal combustion engines. A microcomputer and associated electronics controls the solenoid valve and pump motor. The microcomputer performs all user interface functions. Firmware provides self test, automatic voltage verification and a variety of safety features. The apparatus includes a fill feature whereby a solution tank is filled automatically. The apparatus is designed to gradually provide power to the pump so that leaks or faulty connections can be detected before the pump reaches full pressure. The apparatus circulates a fuel-cleaner solution through the fuel injection system of the engine while it is operated, thereby saving the time and cost associated with the removal and hand cleaning of injectors. Fuel-cleaner solution level and run time are continuously monitored by the microcomputer and displayed on a LED display. Fuel-cleaner solution pressure is continuously monitored for leaks due to faulty hose connections. An automated leak test feature allows the user to check for leaks in the fuel injectors and pressure control valve without removing them from the engine. An audio alarm comprised of many unique sets of frequencies alerts the operator when necessary.

20 Claims, 8 Drawing Sheets

MICROCOMPUTER CONTROLLED ENGINE CLEANING SYSTEM

FIELD OF THE INVENTION

This invention relates to an engine cleaning system, and more specifically to a microcomputer controlled engine cleaning system.

BACKGROUND OF THE INVENTION

A problem common to internal combustion engines is the build-up of carbon and other organic compounds on the internal engine surfaces. If ignored, this build-up of material causes parts to change in both shape and size. This change is considered more detrimental today because, in addition to a loss of efficiency, air pollution is drastically increased. If left undeterred, small orifices get closed off and the engine eventually ceases to operate.

This problem is particularly acute in fuel injector engines. Today, with increased awareness of air pollution caused by the inefficient burning of petroleum products, it is important to keep fuel injectors and their associated parts clean. An early solution to this problem was to dismantle the engine and physically scrape or sandblast the deposits off of the engine parts. However, dismantling an engine and a fuel delivery system requires a relatively long down time, and is very skilled-labor intensive. As a result, it is a very expensive choice and, therefore, not performed very often.

In order to reduce the amount of time and costs required to maintain the integrity of these components, solvents have been developed that removes some of the deposits and makes the remaining removal processes less labor intensive. U.S. Pat. No. 4,082,565 issued to Sjölander and U.S. Pat. No. 4,804,005 issued to Hartopp disclose an apparatus used to chemically clean injectors that have been removed from an engine.

These solvents have been improved so that they can be added directly to an engine fuel storage tank. The solvent is then allowed to run through the engine in combination with the fuel while the engine is operating. However, this introduced a new problem. In many cases, the solvents did not dissolve the deposits, but rather, the solvents released the deposits. Some of the dislodged particles returned to the fuel tank, while other particles flowed to different parts of the engine. When released, these deposit particles are capable of doing more damage than when they are fixed on the engine parts.

In order to overcome the problem of carbon and organic deposits that did not dissolve completely, new stronger solvents have been formulated that are mixed with limited quantities of fuel in a mixing tank and circulated through the fuel system of the engine while the engine is running. Unfortunately, these new cleaners are so corrosive that they cannot be added to the fuel storage tank of a vehicle because the solvent can dissolve rubber and plastic hoses, and damage some metal parts.

A solution to the problem of having released particles flowing to different parts of the engine, and of having a solvent that is too corrosive for the fuel tank, was to provide fuel and solvent to the engine from a separate fuel and cleaning solvent mixing tank system. In this way, the released particles are returned to the mixing tank system, and the corrosive solvents are kept away from the fuel tank and rubber hoses of the vehicle. The excess fuel-cleaner mixture, along with the released particles that have returned to the mixing tank, may then be properly discarded.

These types of separate fuel and solvent mixing tank systems have been improved upon by adding pressure control devices, controls for operating the injectors, and a timing device that allows a run or cleaning cycle to proceed without the supervision of a user. Prior art systems are made portable by placing it on a wheeled dolly, thereby allowing these systems to be easily moved to and from the engine to be serviced.

Typical prior art systems such as the ones described above are disclosed in U.S. Pat. No. 4,520,773 issued to Koslow, U.S. Pat. No. 4,606,311 issued to Reyes et al., and U.S. Pat. No. 4,877,043 issued to Carmichael. However, these prior art systems have certain drawbacks in that they require the user to be specifically trained to operate the systems. The user must properly set toggle switches and gauges, and the user must monitor the fluid pressure during the use of the system to ensure proper operation. The prior art systems also require a series of switches and relays to operate solenoid valves and a pump. These components are prone to failure due to their electro-mechanical nature.

Furthermore, in the prior art systems, a pump is used to supply cleaning solution to the engine being cleaned. These pumps are connected to a power source such that full power is applied to the pump at start up, thereby causing the pump to reach full pressure very rapidly. This creates a potentially dangerous situation, since the connections that have been made between the engine and the system may not be secured or leak proof. If one of these connections were to spring a leak or dislodge from the engine upon start up, since the pump starts pumping at full pressure upon start up, there is likely to be a spillage of fuel and corrosive solvents, which presents a hazardous condition.

Another problem in the prior art systems is that a certain amount of remaining fuel and solvent always spills out from the connectors when removed from the engine. U.S. Pat. No. 4,877,043 issued to Carmichael teaches the operation of the pump in reverse to remove fuel from supply lines. This feature is useful in the case of a leak, or when the cleaning cycle operation is completed. However, in prior art systems, the pump continues to operate in the reverse mode until the user manually turns off the pump.

Although operation of the pump in this mode removes cleaning solution from the lines, it also removes cleaning solution from the pump. Therefore, after 4 or 5 seconds, the pump begins to operate without lubrication. If the user is not monitoring the system to manually stop the pump, the pump will continue to operate until it is turned off, or until it breaks down. This results in reduced pump life, or pump failure.

Also known in the prior art are systems that utilize a plurality of valves to perform a leak test on the engine's fuel delivery system by connecting the system to the engine while the engine is off, supplying a fluid into the engine, and then trapping the fluid in the engine at a predetermined pressure for a predetermined period of time. If the pressure drops significantly, then that is an indication of a leak in the engine.

This feature is very useful in that it provides an easy way to check the fuel injectors and the engine's fuel pressure regulator valve for leaks. However, the prior art requires the user to perform several steps in order to properly run this test. The user must monitor the pressure during the test, and should be present at the end of the test, or set an alarm to alert him at the completion of the test. At the completion of the test, the user must remember to bleed off the remaining pressure. Otherwise, when he disconnects the lines, fluid will spill out since the lines still contain pressurized cleaning solution. The prior art systems typically utilized a three-way solenoid valve, a check valve, and associated tubing and fittings. With more connections made to the engine, or more valves used in the connections, there is a greater likelihood that one of the connections or valves may leak, giving the false impression that there is a leak in the engine.

Therefore, a better solution is needed to provide an engine cleaning system that addresses some of the drawbacks associated with prior art systems, as discussed above.

SUMMARY OF THE INVENTION

A microcomputer controlled engine cleaning system of the present invention for removing deposits in an engine provides a carbon-cleaning system for internal combustion engines that is easy to use, automated, more reliable, and less expensive to manufacture. This is accomplished through the use of electronic switching circuits controlled by a microcomputer comprising a microprocessor and operating program which is preferably stored in firmware. In this way, the mechanical problems inherent in mechanical switches, relays and solenoids are reduced. Furthermore, all controls are operated by solid state devices.

The cleaning system of the present invention automatically performs self tests and alerts the user via a warning read-out if there is a malfunction. The user need not attach it to an engine and have it fail to find out that it is not operating properly.

The cleaning system requires less operator set-up and less operator manual adjustments than the prior art systems since electronic sensing devices, which send signals to the microcomputer, make the necessary adjustments automatically. This reduces user training time, and the amount of labor required during operation of the cleaning system.

The cleaning system of the present invention also provides an electronic timer which is used for both the leak test and run or cleaning mode cycles. The timer is easily adjusted both prior to and during the cleaning or leak test procedures.

In addition, the cleaning system provides a cleaning solution tank level monitor and display which can be individually calibrated, via self-contained electronics, for each specific solution tank level monitor unit during the manufacturing process. This reduces the amount of manual labor required during assembly, while also providing the user with an accurate indication of the remaining cleaning solution for a given solution tank.

Another unique feature of the cleaning system of the present invention is that the cleaning system provides an apparatus which monitors and checks the current being supplied to the pump. The pump current is monitored for both peak and average values. By monitoring the peak current, the microcomputer is able to protect the pump and its associated motor, from excessive current surges. By monitoring the average current, the microcomputer is able to insure that, in the case of a malfunction in the fluid handling system, the maximum system pressure will never exceed a predetermined level.

To reduce potentially dangerous leaks during start up, the cleaning system incorporates an automatic gradual start function. This feature gradually increases the fuel pump pressure and volume in order to provide the user with the time necessary to observe whether the connectors or supply lines are properly connected, and not leaking.

A microcomputer operating program is designed to monitor fluid pressure in the supply lines during purging (reverse pump motor operation), and to monitor the reverse operating time duration of the pump during the purge mode. When the pressure drops below a predetermined level, or when a predetermined amount of time expires, whichever is first, the pump is automatically turned off. This prevents operation of the pump without lubrication, thereby reducing wear and tear on the pump, and increasing the useful life of the pump.

Furthermore, the cleaning system of the present invention provides a unique and improved way of conducting a leak test, eliminating some of the drawbacks associated with the prior art. First, the leak test mode is fully automated. The actuation of a single switch enables the microcomputer to perform all of the leak test functions, as well as to set an internal completion timer with an alarm. Second, significant manufacturing costs are saved since only one two-way solenoid value is used, as compared to the cost of a three-way solenoid valve and a check valve used in a typical prior art system. No additional lines or fittings are required.

By eliminating all relays, the check valve used in the leak test, and by replacing the three-way solenoid valve with a two-way solenoid valve, the cleaning system of the present invention significantly reduces assembly time and material cost.

Accordingly, in addition to the objects of the present invention as discussed above, it is to be understood that further objects and advantages of the present invention will become apparent from a consideration of the drawings and ensuing description.

DETAILED DESCRIPTION OF A PREFERRED EMBODIMENT

Figure 1:
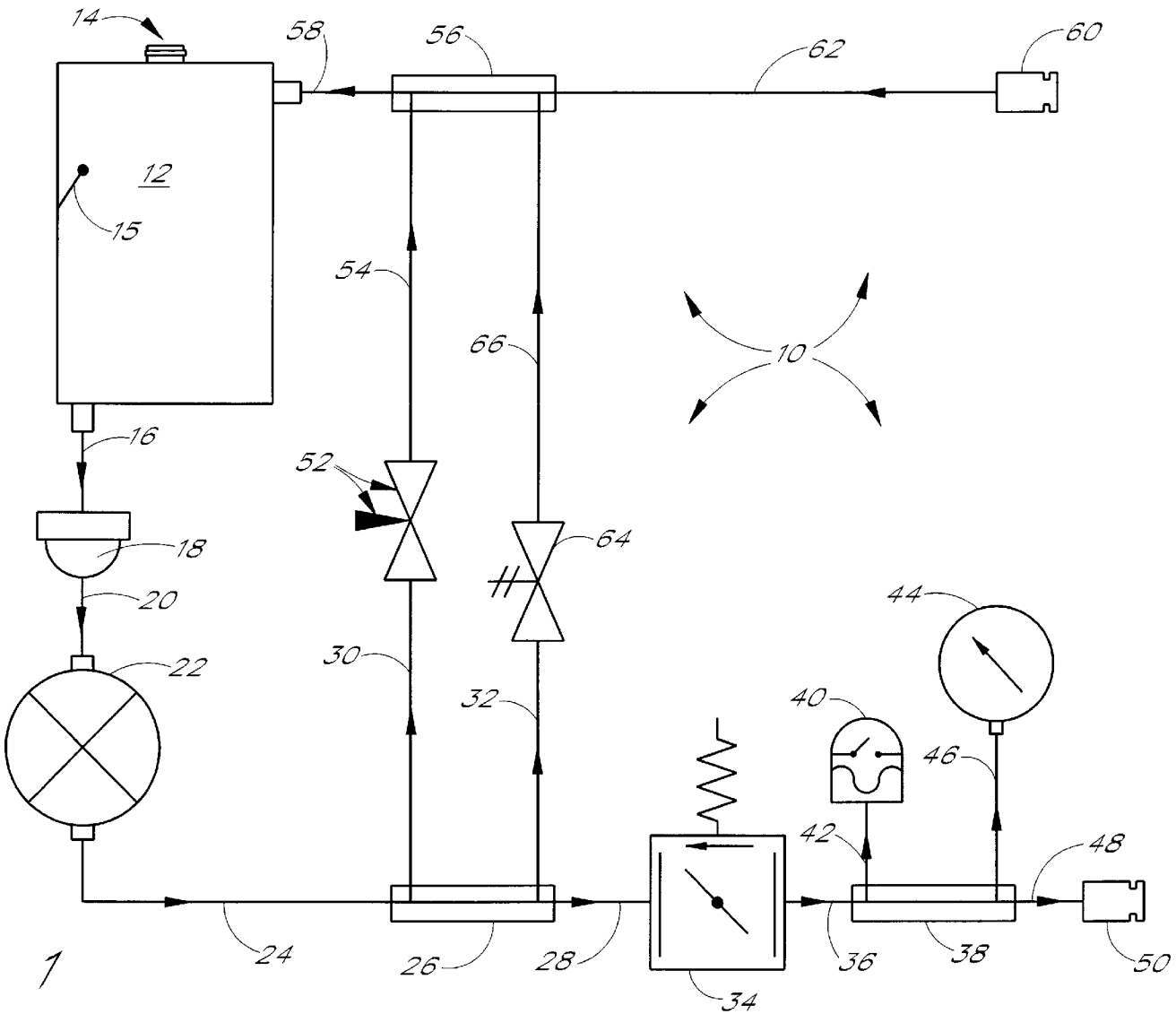
FIG. 1 is a block diagram of a preferred embodiment of a microcomputer controlled engine cleaning system showing fluid communication between system components.

FIG. 1 is a block diagram of a preferred embodiment of a microcomputer controlled engine cleaning system 10 showing fluid communication between system components. Basically, a solution tank 12 filled with solution (not shown) is pumped into an engine (not shown) through a series of system components and an input connector 50. The solution cleans the engine accordingly, as previously discussed, and any remaining solution is returned from the engine to the solution tank 12 via an output connector 60.

The microcomputer controlled engine cleaning system 10 (also referred to as the cleaning system 10) comprises the solution tank 12, a filter 18, and a pump 22. The solution tank 12 comprises a cap 14 covering an opening that is used for filling the solution tank 12 with solution, and a tank level monitor 15 located inside the solution tank 12 that is used to determine the amount of solution remaining in the solution tank 12.

A tank output hose 16 and a tank input hose 58 are in fluid communication with the solution tank 12. The tank output hose 16 carries solution out of the solution tank 12 during a run mode, and carries solution back into the solution tank 12 during an autopurge mode, or during a fill mode. The tank input hose 58 carries solution back into the solution tank 12 from the engine during the run mode, and also carries solution back to the solution tank 12 from the pump 22 in order to help control the pounds per square inch (psi) pressure of the solution being supplied to the engine. Detailed discussions regarding these and other modes are provided further below.

In the run mode, the pump 22 pumps solution out of the solution tank 12 via the tank output hose 16 and through the filter 18. The solution is then carried to the pump via a filter hose 20. The pump 22 then pumps the solution through a pump hose 24 to a first four-way hose connection 26. The first four-way hose connection 26 is in fluid communication with the pump hose 24, a first hose 28, a second hose 30, and a third hose 32. The solution can flow into the first four-way hose connection 26 via the pump hose 24 during run mode, and via the first hose 28 during autopurge or fill mode. The solution can flow out of the first four-way hose connection 26 via the pump hose 24 during autopurge or fill mode, via the second hose 30 during run mode to control the solution psi being supplied to the engine, and via the third hose 32 when excessive pressure build up is detected, as discussed in further detail below.

The primary path for the solution during run mode is the first hose 28. The solution is carried by the first hose 28 to a solenoid valve 34. The solenoid valve 34 is normally in a closed position, but is open when the pump 22 is operating. The solution passes through the solenoid valve 34 and is carried by a solenoid valve hose 36 to a second four-way hose connector 38. The second four-way hose connector 38 is in fluid communication with the solenoid valve hose 36, a low pressure gauge hose 42, a gauge hose 46, and an input connector hose 48. The solution can flow into the second four-way hose connector 38 via the solenoid valve hose 36 during run mode, and via the input connector hose 48 during autopurge or fill mode, and via the low pressure gauge hose 42, and gauge hose 46, during autopurge mode. The solution can flow out of the second four-way hose connector 38 via the solenoid valve hose 36 during autopurge or fill mode, and via the input connector hose 48, low pressure gauge hose 42, and gauge hose 44 during run mode.

Figure 2:
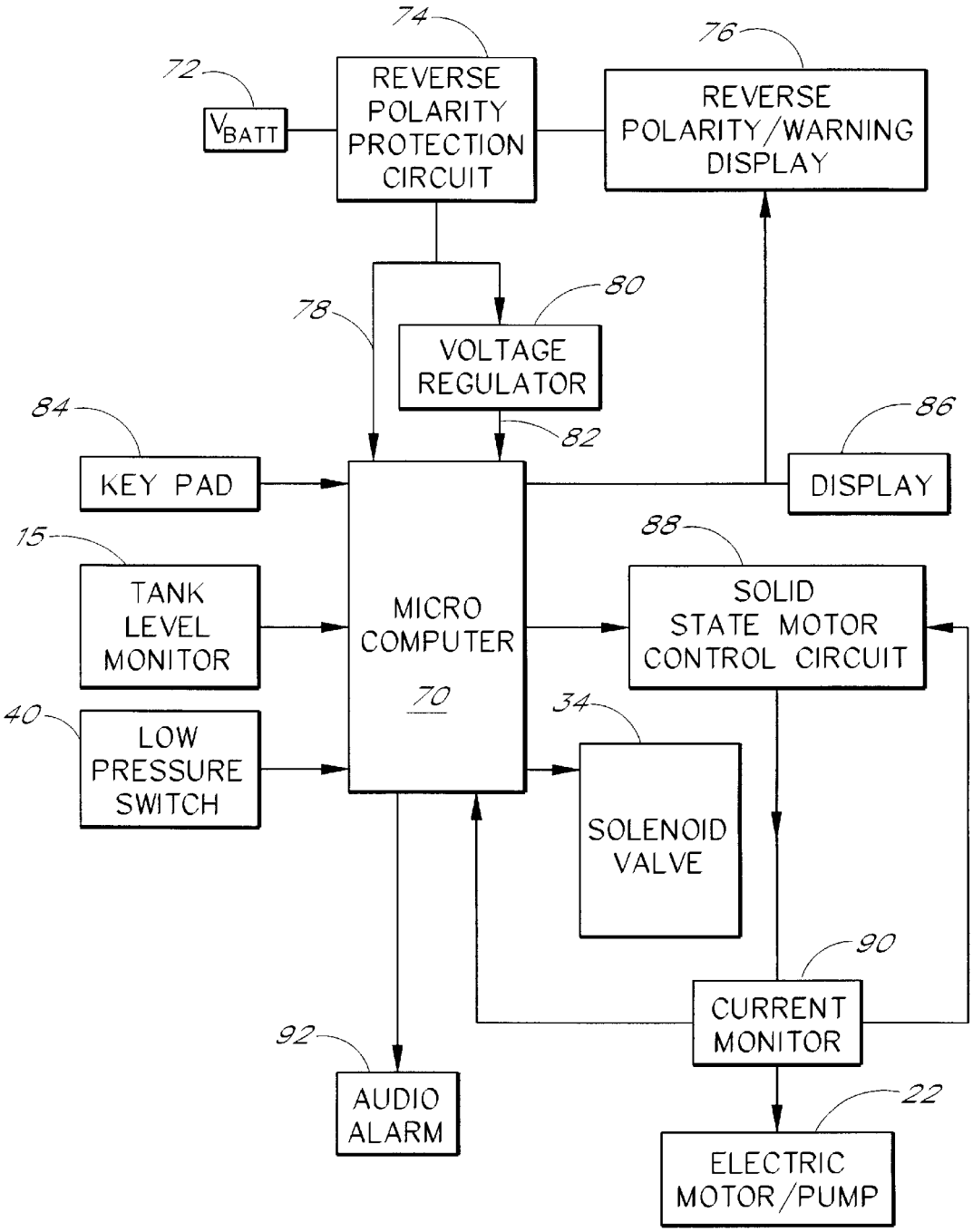
FIG. 2 is a block diagram of a preferred embodiment of a microcomputer controlled engine cleaning system showing electrical communication between system components.

The portion of solution that flows out of the second four-way hose connector 38 via the low pressure gauge hose 42 flows to a low pressure gauge 40 which is used to determine the psi of the solution being supplied to the engine, and then providing that information to a microcomputer 70 (as shown in FIG. 2) for processing, as discussed in further detail below. The portion of solution that flows out of the second four-way hose connector 38 via the gauge hose 46 flows to a gauge 44 which is used to visually display to a user the psi of the solution being supplied to the engine, so that manual adjustments can be made if necessary.

The primary path for the solution during the run mode is the input connector hose 48. The solution flows through the input connector hose 48 and into the engine via the input connector 50. It is to be understood that any type of connector, even an end of a hose, which provides a passageway for fluid to flow between the input connector hose 48 and the engine, may be used as the input connector 50. The same is also true for the output connector 60.

Referring back to the first four-way hose connector 26, solution that exits the first four-way hose connector 26 via the second hose 30 flows into a regulating needle valve 52. The regulating needle valve 52 is a manually adjustable pressure valve that is used to control the psi of the solution being supplied to the engine.

For example, if a desired solution psi being supplied to the engine is 10 psi, then the regulating needle valve 52 is set to a corresponding position that provides solution at 10 psi to the engine. If the pump 22 increases the pressure of the solution being supplied to the engine to 12 psi, for example, then the regulating needle valve 52 opens up, since it is designed to open up at any detected psi above the set psi which in this case is 10 psi, and allows solution to pass through the regulating needle valve 52 and back to the solution tank 12 until the pressure of the solution is reduced back down to 10 psi, at which time the regulating needle valve 52 closes, so that the pressure will not drop below 10 psi.

If for some reason, the first hose 28 and/or the second hose 30 become clogged up such that the pressure of the solution flowing into the first four-way hose connector 26 via the pump hose 24 reaches an unsafe level, the third hose 32 provides a safety valve. Solution that flows through the third hose 32 during run mode is usually blocked by an overpressure valve 64. However, the overpressure valve 64 is designed to open if the solution reaches a predetermined unsafe psi, which in a preferred embodiment is 115 psi. Therefore, if a blockage in the first hose 28 and the second hose 30 causes the solution being supplied by the pump hose 24 to reach 115 psi, then the overpressure valve 64 opens up, and lets the solution flow through the overpressure valve 64 and back to the solution tank 12.

The solution flowing through the overpressure valve 64 is carried by an overpressure valve hose 66 to a third four-way hose connector 56. The third four-way hose connector 56 is in fluid communication with the overpressure valve hose 66, a regulating needle valve hose 54, the tank input hose 58, and an output connector hose 62. The regulating needle valve hose 54 is positioned between the regulating needle valve 52 and the third four-way hose connector 56. This provides the solution passing through the regulating needle valve 52 a passageway back to the solution tank 12.

The solution can flow into the third four-way hose connector 56 via the regulating needle valve hose 54 and overpressure valve hose 66 when a certain solution psi is exceeded during run mode, and via the output connector hose 62 during run mode. The solution can flow out of the third four-way hose connector 56 via the tank input hose 58 during run mode. Solution flowing out of the third four-way hose connector 56 via the tank input hose 58 flows back into the solution tank 12.

Now having completed a description of the various paths of fluid flow between various components in the cleaning system 10, the following discussion relating to FIG. 2 describes the various paths of electrical communication between various components in the cleaning system 10.

FIG. 2 is a block diagram of a preferred embodiment of a cleaning system 10 showing electrical communication between system components. To power up the cleaning system 10, a user connects the cleaning system 10 to an external power source, preferably a car battery 72, via a power cable (not shown). A reverse polarity protection circuit 74 is provided to ensure that the user does not connect the cleaning system 10 to the wrong terminals on the battery 74. If the user does connect the cleaning system 10 to the wrong terminals on the battery 74, a reverse polarity display 76, which is in electrical communication with the reverse polarity protection circuit 74, provides a visual indication to the user that the connection is backwards. Furthermore, the reverse polarity protection circuit 74 will not allow current to flow to the microcomputer 70 until the user properly connects the battery 72. In a preferred embodiment, the reverse polarity display 76 is also used as a warning display 76, and is in electrical communication with the microcomputer 70.

Once the cleaning system 10 is properly connected to the battery 74, a 12 volt line 78 is provided to the microcomputer 70 for control and distribution to various cleaning system 10 components, such as to the pump 22 during run mode. Power is also provided to a voltage regulator 80 via the reverse polarity protection circuit 74 so that the 12 volt feed from the car battery 72 can be stepped down to 5 volts for use by the various electronic components. The voltage regulator 80 provides a 5 volt line 82 to the microcomputer 70 for control and distribution to various cleaning system 10 components, as well as to provide operating power to the microcomputer 70.

A keypad 84 is provided with the cleaning system 10, and is in electrical communication with the microcomputer 70. The keypad is used to select the various modes of operation available on the cleaning system 10. Further details on the various modes available are discussed below.

The tank level monitor 15 in the solution tank 12 is in electrical communication with the microcomputer 70, so that the microcomputer 70 can provide a visual display to a user indicating the remaining solution level in the solution tank 12. Such a visual display is provided by a display 86. The display 86 is in electrical communication with the microcomputer 70, and is also used to provide a visual indication of various other features of the cleaning system 10, as discussed further below.

The low pressure gauge 40 is in electrical communication with the microcomputer 70 to provide the microcomputer 70 with signals relating to the solution psi being provided to the engine. A carburetor engine typically operates with a fuel pressure somewhere between 4–7 psi. Therefore, in a preferred embodiment, the low pressure gauge 40 is designed to provide a signal to the microcomputer 70 whenever the solution psi being provided to the engine exceeds 4 psi, thereby informing the microcomputer 70 that adequate pressure exists for the run mode. Furthermore, the low pressure gauge 40 is used to detect leaks or accidental disconnections of the input connector 50 from the engine. For example, if the input connector 50 dislodges from the engine, then the solution psi will drop. Thus, the low pressure gauge 40 is designed to send a signal to the microcomputer 70 if the solution psi being provided to the engine drops below 2 psi from a psi above 4 psi.

An audio alarm 92, capable of creating a plurality of distinct audible alarm sounds relating to various situations, such as a low pressure gauge 40 signal indicating psi below 2 psi, is placed in electrical communication with the microcomputer 70.

The microcomputer 70 is placed in electrical communication with a motor control circuit 88. The motor control circuit 88 is controlled by the microcomputer 70 to turn the pump 22 on and off, and to control the direction of the pump 22, i.e., pumping solution to the engine during run mode, or pumping solution to the solution tank 12 during fill mode. The microcomputer 70 controls the pump 22 according to a user's input into the keypad 84.

The motor control circuit 88 is placed in electrical communication with a current monitor 90. The current monitor 90 is designed to shut down the motor control circuit 88 if a predetermined current level is reached to prevent damage to the motor control circuit 88. In a preferred embodiment, the current monitor 90 shuts down the motor control circuit 88 if the current flowing through the motor control circuit 88 and current monitor 90 exceeds 10 amperes. The current monitor 90 is also designed to provide a signal back to the microcomputer 70 if the detected current reaches another predetermined current level. It has been determined that a current through the motor control circuit 88 of approximately 7.5 amperes is indicative of a solution psi in the cleaning system 10 of approximately 115 psi. When the monitored current exceeds 7.5 amperes, the current monitor 90 provides a signal to the microprocessor 70 to shut down the pump 22. This safety feature is redundant with the overpressure valve 64, but is deemed important due to the potential danger presented by such a high solution psi. The pump 22 is in electrical communication with the current monitor 90, which provides the 12 volt voltage supply to run the pump 22, as well as signals to indicate the direction of the pump 22.

The microcomputer 70 is in electrical communication with the solenoid valve 34. Whenever the microcomputer 70 directs power to the pump 22, the solenoid valve 34 is also provided with power in order to open the solenoid valve 34 from its normally closed position. As discussed further below, the primary purpose for the solenoid valve 34 is to operate a leak test mode, wherein the solution is provided to the engine and then trapped inside the engine for a period of time to determine if the trapped solution psi drops significantly. A significant drop indicates a leak within the engine, and an insignificant drop indicates that the engine seals are operating properly. The solenoid valve 34 prevents the solution from exiting the engine and flowing back into the cleaning system 10.

Now having completed a description of the various paths of electrical communication between various components in the cleaning system 10, the following discussion describes the operational flow of the various modes, in relation to FIGS. 3–8 that show flow charts for the various modes. It is to be understood that various paths can be taken during the operation of the cleaning system 10, and that these variations are known to those in the art. The following description follows one particular path to illustrate all of the steps involved in operating the cleaning system 10 of the present invention.

Figure 3:
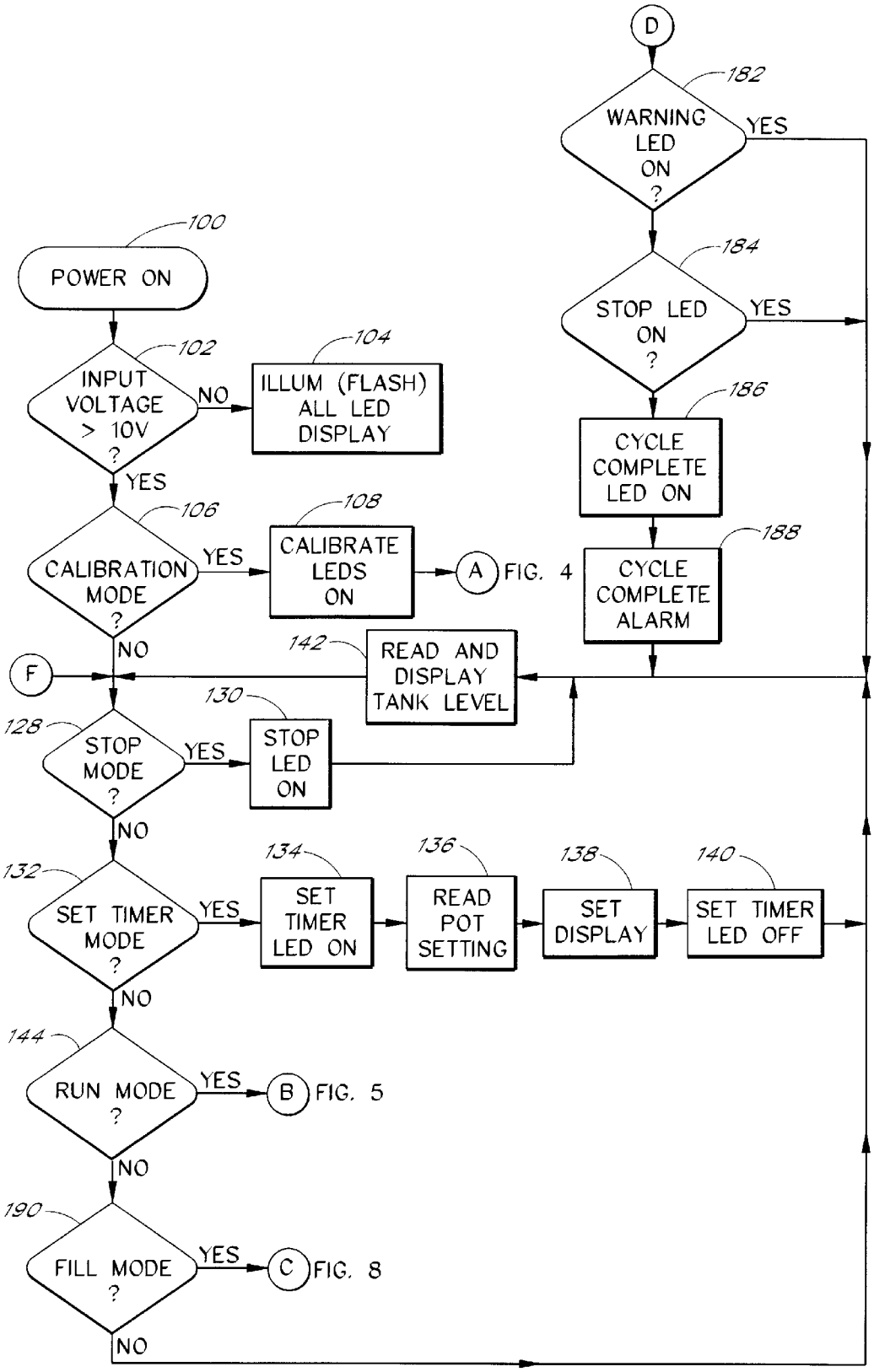
FIG. 3 is a flow chart showing the initial power on steps, set timer steps, and stop steps.
Figures 3, 4:
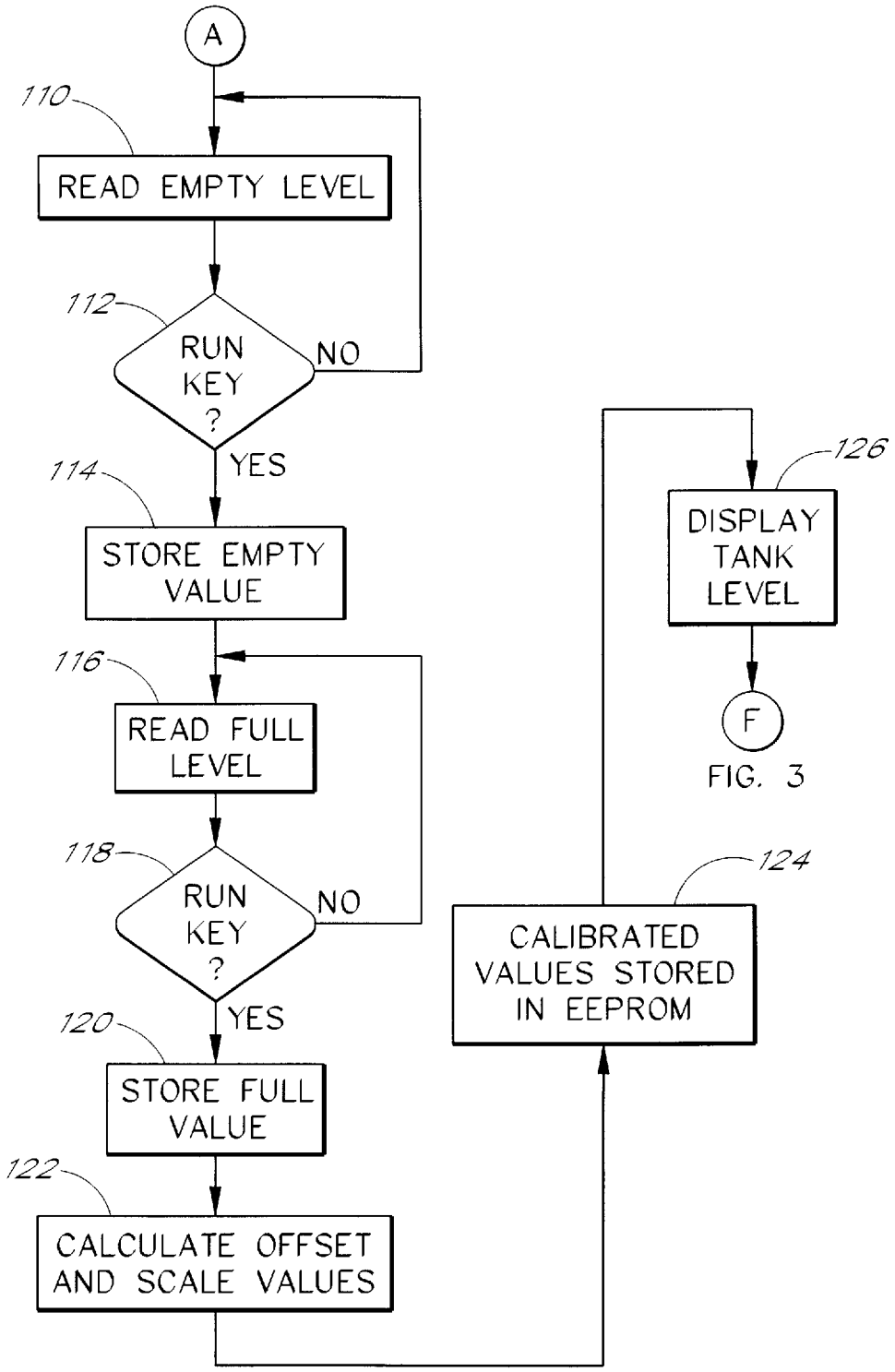
FIG. 4 is a flow chart showing the calibration steps.
Figure 5:
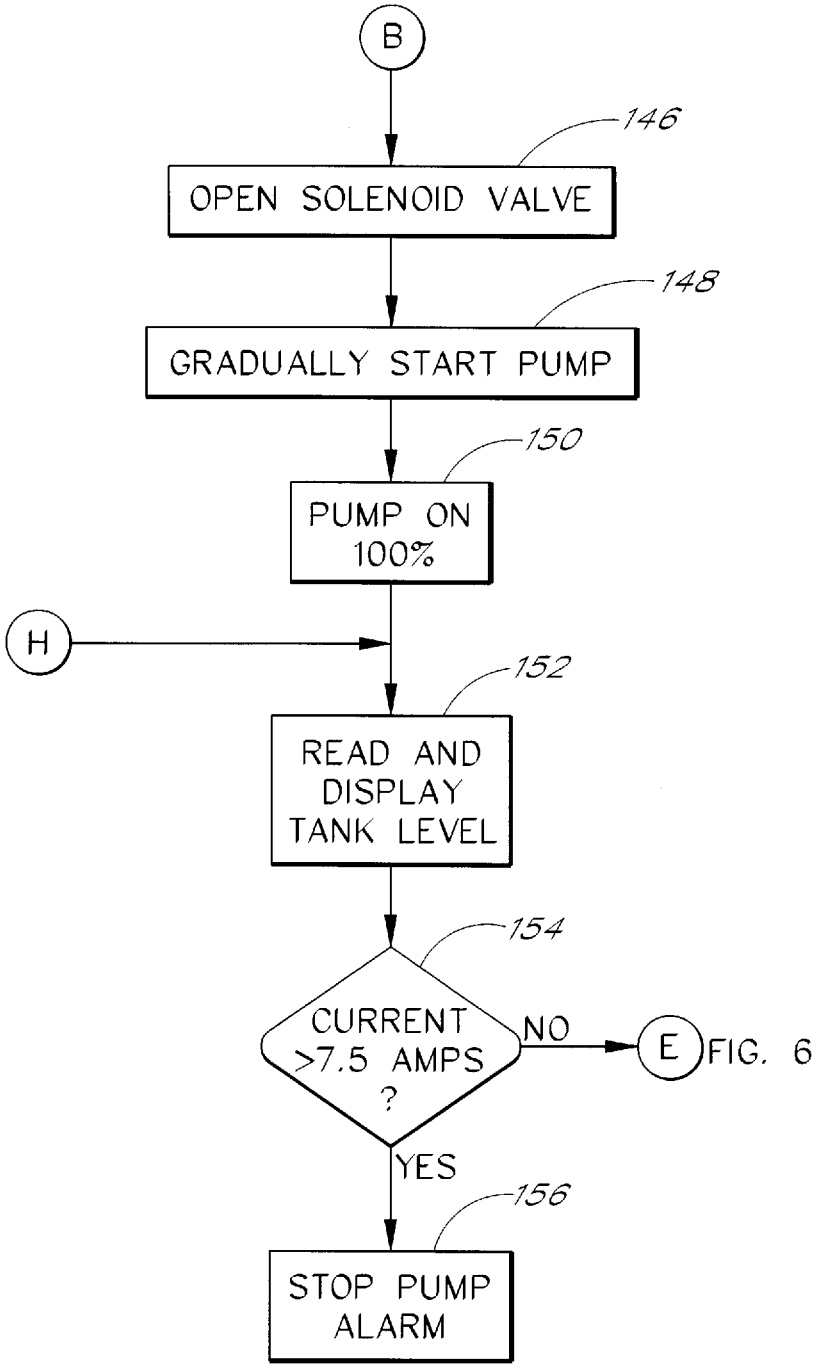
FIG. 5 is a flow chart showing the run mode steps.

FIG. 3 is a flow chart that starts with the initial power on step 100 of the cleaning system 10. The microcomputer 70 then determines whether the input voltage is greater than 10 volts 102. If it is not, then the car battery 72 is not providing sufficient energy to the cleaning system 10, and the display 86 flashes to indicate this insufficiency 104. If the input voltage from the car battery 72 is greater than 10 volts, then a user, typically at the factory, is given the option to enter a calibration mode 106. If the user at the factory decides to enter the calibration mode, an LED (not shown) on the display 86 corresponding to the calibration mode is turned on 108. Following the flow chart arrow from 108 to "A" on FIG. 4, this figure shows the steps involved in the calibration mode.

In the calibration mode, the microcomputer 70 reads the tank level monitor 15 as being at an empty level 110 until the user depresses the run key (not shown) located on the keypad 84 as shown in step 112. Once the run key is depressed, the microcomputer 70 equates an electrical value received from the tank level monitor 15 with the mechanical position of a level indication lever (not shown) and stores this value as an empty level 114. The user is then required to raise the level indication lever to a maximum position, at which time the microcomputer 70 equates an electrical value received from the tank level monitor 15 with the raised mechanical position, step 116, and when the user depresses the run key again, step 118, the microcomputer 70 stores this value as a full level 120. The microcomputer 70 then takes the empty level value and full level value, and normalizes these values so that the solution level in the solution tank 12 can be displayed on the display 86 utilizing a full range of LEDs corresponding to this function, step 122. This normalized scale for the values generated by the tank level monitor 15 are then stored in an electrically erasable programmable read only memory (EEPROM) (not shown) within the microcomputer, step 124. The display 86 is now capable of displaying the solution level in the solution tank 12 depending upon the position of the tank level monitor 15, step 126.

Following the flow chart arrow from 126 back to "F" on FIG. 3, the microcomputer 70 now goes into a stop mode 128, and turns on a stop LED on the display 86, step 130, and then reads and displays the tank level, step 142. At this point, if the user decides to enter a set timer mode, the user depresses the set timer key on the keypad 84, step 132 which turns on the set time LED on the display 86, step 134. In a preferred embodiment, the user then uses a dial, or potentiometer (not shown), to dial in a predetermined time duration for a given mode, such as the run mode. The potentiometer takes this input and converts it into an electrical representation of a predetermined time duration. This generated corresponding electrical value is then read by the microcomputer 70, step 136, and that time value is then displayed on the display 86, step 138. In a preferred embodiment, twelve LEDs are provided with each LED representing 5 minute increments. Therefore, if fifteen minutes is selected as the predetermined time duration, then three LEDs are turned on to represent fifteen minutes as the selected value. If a few seconds elapse after the user dials in a time duration value, or if the user depresses the set timer key again, then the set timer LED on the display 86 turns off 140, the microcomputer 70 reads and displays the current tank level 142, and the microcomputer 70 is brought back to the stop mode 128.

Now, assume that the user decides to enter into the run mode by depressing the run mode key on the keypad 84, step 144. Following the flow chart arrow from 144 to "B" on FIG. 5, the microcomputer 70 opens the solenoid valve 34, step 146, and then soft starts the pump 22, step 148. Once the pump is running at 100 percent, step 150, the microcomputer 70 reads and displays the tank level 152. The microcomputer 70 then determines whether the signal received from the current monitor 90 indicates that the current being supplied to the motor control circuit 88 and current monitor 90 exceeds a predetermined value, step 154. If, in a preferred embodiment, the microcomputer 70 determines that the current monitor 90 is reading a current level greater than 7.5 amperes which equates to 115 psi for the solution, then the microcomputer 70 stops the pump 22 and sounds a distinct audible alarm via the audio alarm 92, step 156. Typically, hitting the stop key will turn off the audio alarm, but in this situation, the alarm continues to sound, since solution psi above 115 psi presents a potentially dangerous situation.

Figures 3, 6:
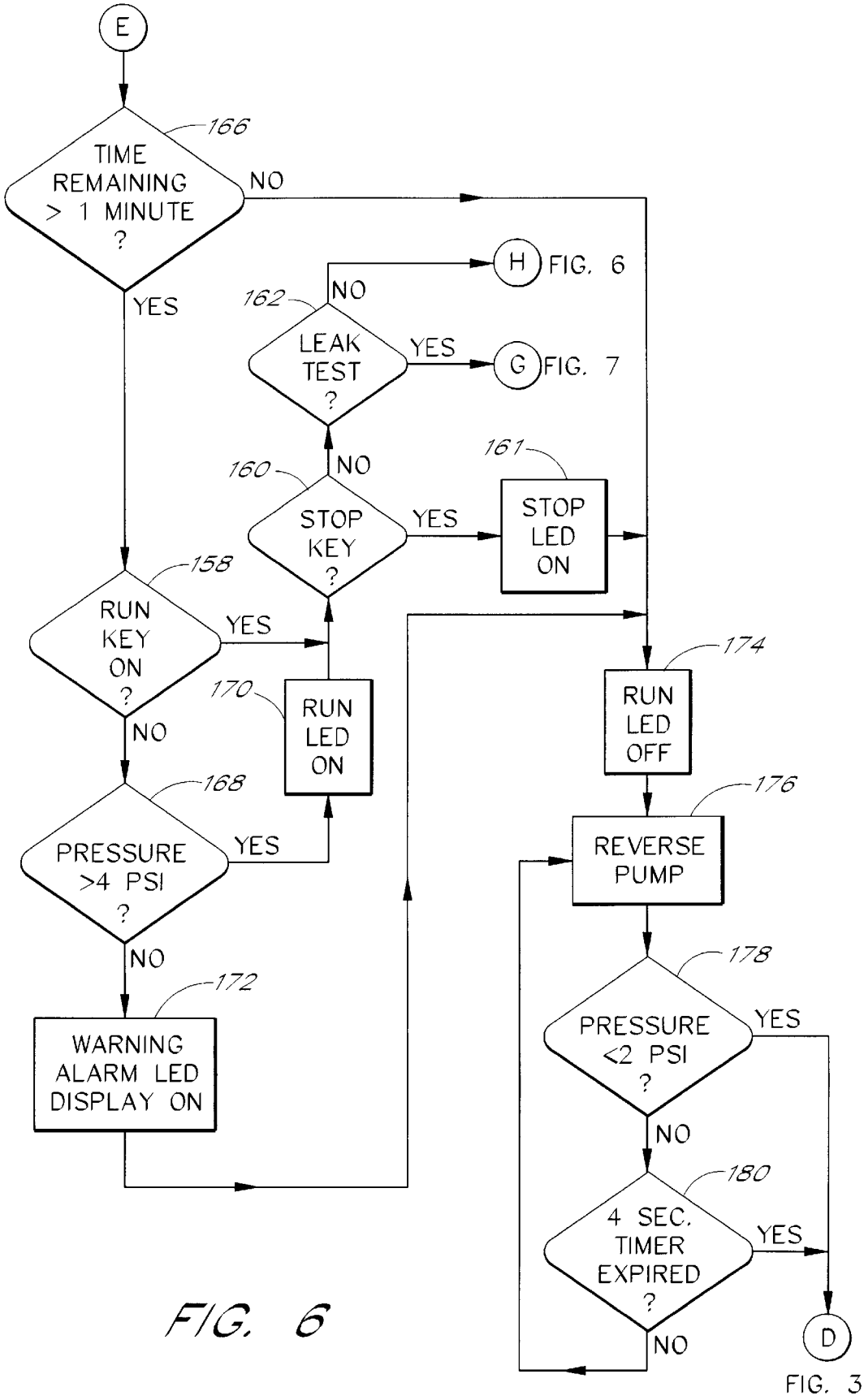
FIG. 6 is a flow chart showing the run mode steps.

However, if the microcomputer 70 determines that the current is within an acceptable range, then the operation of the microcomputer 70 follows the flow chart arrow from 154 to "E" on FIG. 6. FIG. 6 is a portion of the flow chart showing the run mode steps. In step 158, the microcomputer 70 determines whether the user is still depressing the run key on the keypad 84. To enter the run mode properly, the user must keep the run key depressed until the solution psi to the engine reaches above 4 psi. If the user releases the run key prior to the solution psi reaching above 4 psi, it is considered a user response to a leak or improper connection, and a shut down process is initiated. The reason for this is that while the pump 22 is building up solution psi to the engine from 0 psi to 4 psi, the user keeps the run key depressed, while observing for problems. Most problems become apparent before solution psi reaches above 4 psi. Therefore, if the user sees a problem, the only thing the user must do is release the run key and the cleaning system 10 will shut down. With this explanation in mind, we refer back to step 158.

Assuming the user still has the run key depressed, the user may decide to manually return to the stop mode by pressing the stop key and releasing the run key, step 160. If the user depresses the stop key, the stop LED is turned on 161 and the run LED is turned off 174. Since some solution is still sitting in the various hoses throughout the cleaning system 10, the microcomputer puts the cleaning system 10 into an autopurge mode which sucks all of the solution in the hoses back into the solution tank 12 by running the pump 22 in reverse, step 176. The autopurge mode runs for four seconds, step 180, or until the solution psi in the cleaning system 10 drops below 1 psi, step 178, whichever is first. Typically, most of the solution will have been sucked back into the solution tank 12 by the time the psi drops below 1, or by the time four seconds expires. Once one of these conditions is met, the operation of the cleaning system 10 follows the flow chart arrow from 178 or 180 to "D" back on FIG. 3.

The microcomputer 70 returns to "D" along various paths, and therefore attempts to determine the cause by first determining whether a warning LED has been turned on, step 182, and then whether the stop LED has been turned on, step 184. If the user depressed the stop key in step 160 on FIG. 6, then the stop light is turned on according to step 161. Thus, in step 184, the microcomputer 70 realizes the reason for the shut down, and proceeds to read and display the tank level 142 and then return to the stop mode 128. However, if "D" is reached by a path wherein the warning LED and the stop LED are not on, then the microcomputer proceeds to step 186, and turns on a complete cycle LED located on the display 86. A distinct audible alarm is also sounded to indicate a completed cycle, step 188. In other words, if the operation of the cleaning system did not reach "D" due to a warning or stop request, then it reached "D" because a cycle, such as a fifteen minute run mode, has been completed. The microcomputer 70 then reads and displays the tank level 142 and returns to the stop mode 128.

Referring back to FIG. 6, step 158, if the user releases the run key and the solution psi is above 4 psi, step 168, then the cleaning system 10 will continue to run since there is no indication of a problem from the user, and microcomputer 70 turns on the run LED, step 170. If the run key is released, and the solution psi is not above 4 psi, step 168, then a warning LED is turned on, step 172, since the microcomputer 70 has been programmed to believe that this is an indication that the user has observed a problem. The microcomputer then proceeds to step 174 and beyond, as discussed above.

In step 160, if the user decides not to depress the stop key, then the user may enter the leak test mode, step 162. If the user decides not to enter the leak test mode, then the microcomputer reads and displays the tank level, step 152 of FIG. 5, and determines whether the current is less than 7.5 amperes, as discussed previously for step 154. If the current is greater than 7.5 amperes, then the stop pump alarm is activated, step 156. If the current is less than 7.5 amperes, then the microcomputer 70 determines whether the remaining time in the predetermined time duration is greater than one minute, step 166 of FIG. 6. If the time duration remaining for a given cycle has dropped below 1 minute, then the microcomputer 70 begins the shut down process by proceeding to step 174 and beyond, as discussed above.

Figure 7:
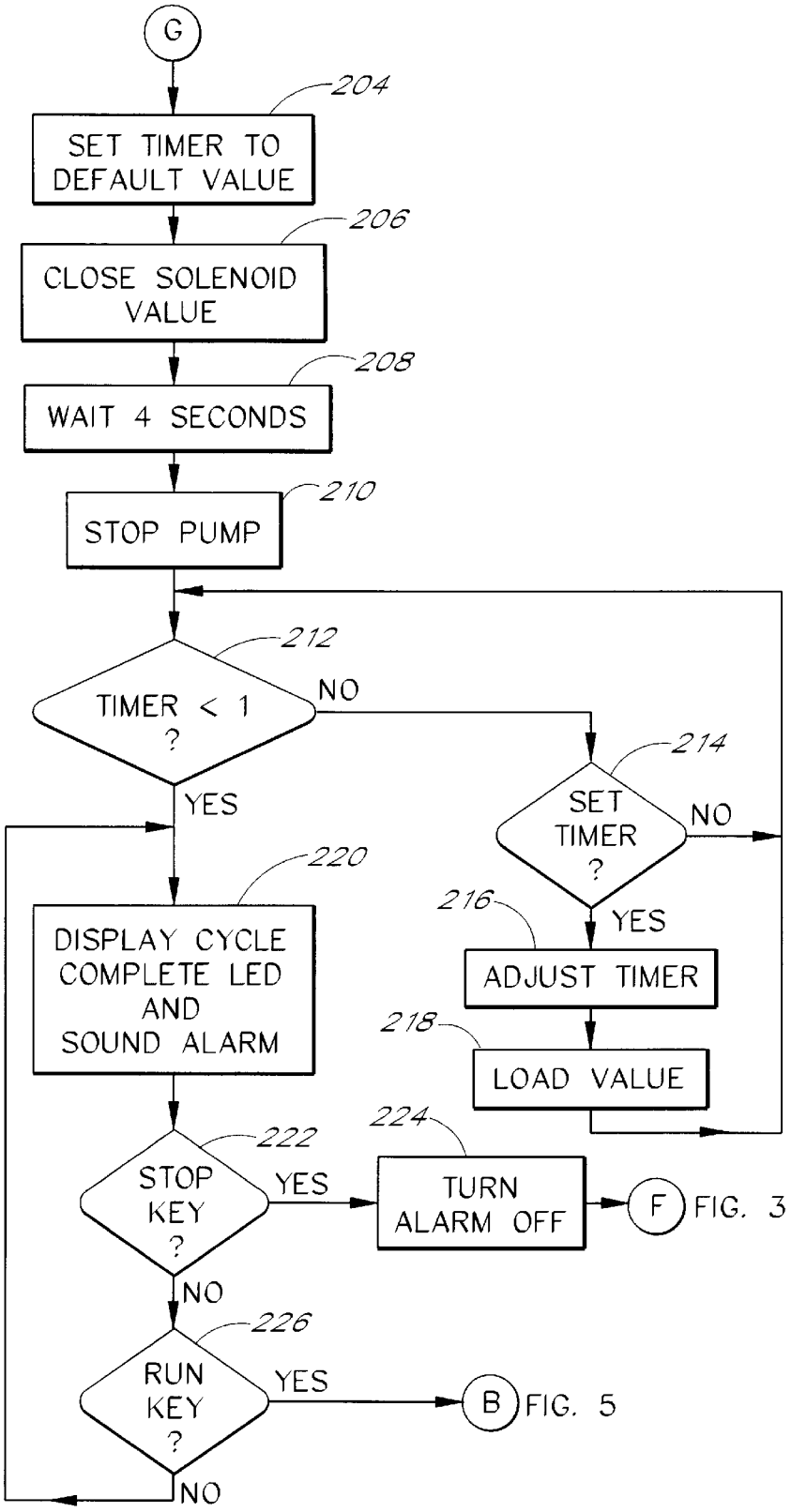
FIG. 7 is a flow chart showing the leak test steps.

If the user decides to enter the leak test mode, step 162, then the operation of the cleaning system 10 follows the flow chart arrow from 162 to "G" on FIG. 7.

FIG. 7 is a portion of the flow chart showing the leak test mode steps. The microcomputer 70 sets the timer (not shown) to a default value, which in a preferred embodiment is five minutes, step 204. This is the predetermined time duration for the leak test mode cycle.

As briefly discussed earlier, the solenoid valve 34 is closed, step 206, in order to trap the solution in the engine. The reason that the solution does not exit the engine through the output connector 60 is that most engines are designed with a one-way release valve (not shown) that is preset to regulate the psi of fuel flowing through the engine. In other words, the one-way release valve will not let fluid flow out of the engine unless the fluid psi is equal to or greater than the psi required to open the one-way release valve. In the leak test, the microcomputer 70 supplies solution to the engine at a psi below the psi setting of the one-way release valve so that the solution is not pressurized enough to exit through the one-way release valve, and cannot return to the cleaning system 10 since the solenoid valve 34 is closed.

In step 208, the microcomputer 70 waits approximately four seconds before turning off the pump 22, step 210. So long as the time remaining in the leak test mode cycle is not less than one minute, step 212, the user may manually modify the time duration remaining by pressing the set timer key, step 214. If the set timer key is depressed, the user may adjust the timer dial, such as the potentiometer (not shown), step 216, and then the microcomputer 70 loads this value, step 218, in place of the default value or the remaining duration of the default value from step 204, and then returns to step 212. If the time duration remaining is not less than one minute, step 212, and the set timer key is not depressed, step 214, then the operation of the leak test mode cycles through steps 212 and 214.

When the time duration remaining in step 212 drops below one minute, then the cycle complete LED is turned on and a distinct audible alarm is sounded, step 220. At this point, the user may return the cleaning system to the stop mode by depressing the stop key 222 which turns off the audible alarm, step 224, and the microcomputer 70 proceeds to "F" on FIG. 3, as discussed previously. The user may also decide to go from the leak test mode to the run mode by depressing the run key, step 226. The microcomputer 70 then proceeds to "B" on FIG. 5, as discussed previously. If neither the stop key or run key are depressed, then the cleaning system 10 continues to display the cycle complete LED and sound the audible alarm, step 220.

Referring back to step 144 in FIG. 3, if the user decides not to run the run mode, then the user may decide whether to run a fill mode, step 190. If the user decides not to run the fill mode, then the microcomputer 70 reads and displays the tank level 142 and returns to the stop mode 128.

Figures 3, 8:
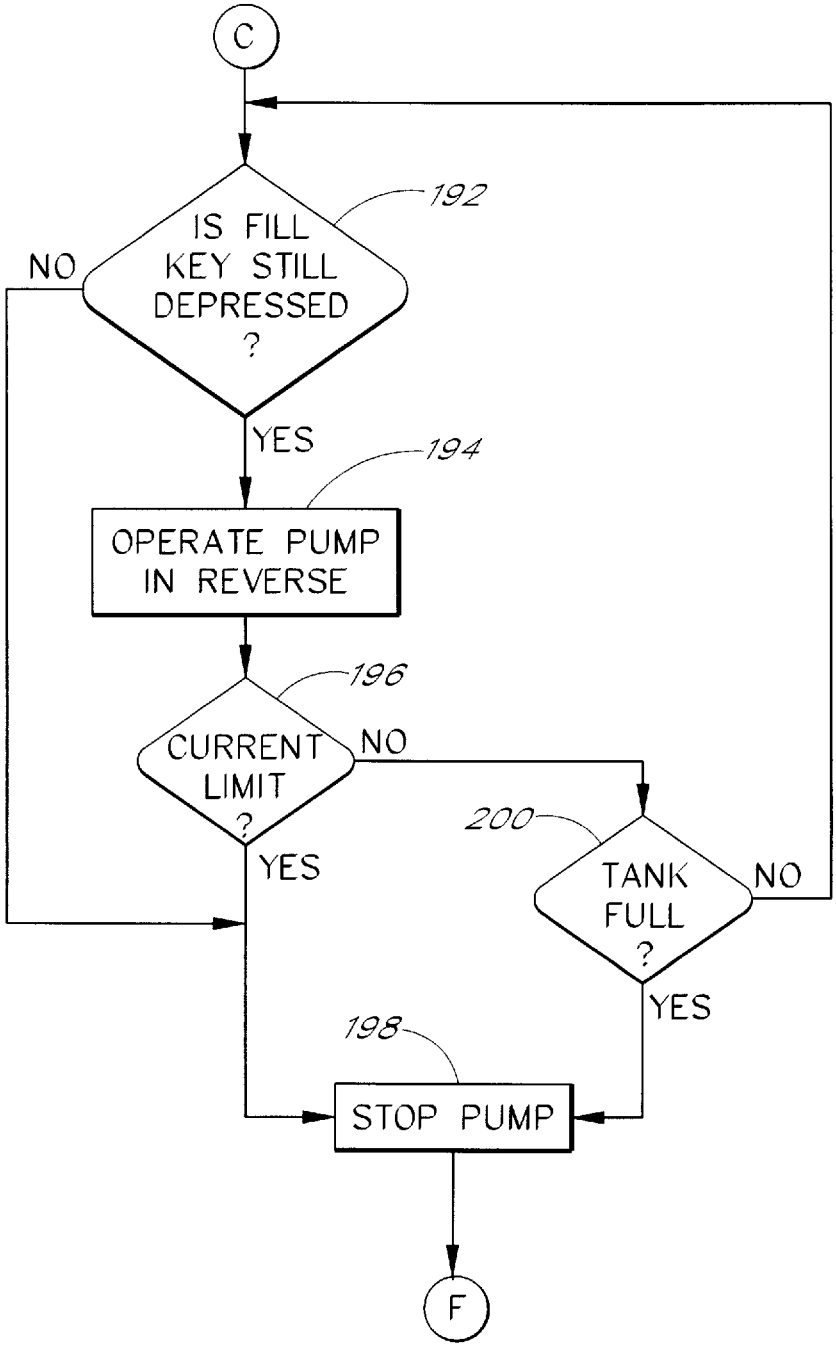
FIG. 8 is a flow chart showing the fill steps.

If the user decides to run the fill mode, step 190, then the operation of the cleaning system 10 follows the flow chart arrow from 190 to "C" on FIG. 8. FIG. 8 is a portion of the flow chart showing the fill mode steps.

Basically, the fill mode provides the user with an optional way of filling up the solution tank 12. One way is to pour a cleaning solution and fuel into the solution tank 12 via the opening in the solution tank 12 covered by the cap 14. Another way is to pour solution into the solution tank 12 via the opening, and then insert the input connector 50 into the fuel tank of an automobile (not shown), or some other convenient source of fuel, such that the pump 22 can be operated in reverse to suck the fuel out of the fuel tank and into the solution tank 12.

The cleaning system 10 only continues to operate in the fill mode if the fill mode key is being depressed. Therefore, in step 192, the microcomputer 70 determines whether the fill mode key is currently being depressed. If the user is currently depressing the fill mode key, the pump 22 starts pumping in reverse, step 194, thereby sucking fuel out of the fuel tank and into the solution tank 12. The microcomputer 70 checks the current monitor 90 to ensure that a predetermined current level, preferable 7.5 amperes representing 115 psi, is not exceeded, step 196. If the current level is within proper range, and does not exceed the predetermined current level, then the microcomputer 70 checks the tank level monitor 15 to determine whether the solution tank 12 is full, step 200. If the solution tank is not full, the microcomputer 70 checks to make sure the fill mode key is still depressed, step 192, and then continues pumping in reverse 194. Once the solution tank 12 fills up, step 200, the pump 22 is turned off, step 198, and the operation of the cleaning system 10 returns to "F" and the stop mode at step 128 on FIG. 3.

Once the user releases the fill mode key, step 192, the pump turns off, step 198, even though the solution tank 12 may not be full. The operation of the cleaning system 10 then returns to "F" and the stop mode at step 128 on FIG. 3.

While the above description contains many specificities, these should not be construed as limitations on the scope of the invention, but rather as an exemplification of preferred embodiments thereof. Many other variations are possible. For example, the specific paths illustrated in these flow charts are being used to describe various features available in the microcomputer controlled engine cleaning system of the present invention, and many alternative paths may be followed, whether shown in the figures, or known to a person of ordinary skill in the art.

What is claimed is:

1. A microcomputer controlled engine cleaning system comprising:

a microcomputer which executes a program for controlling the operation of said engine cleaning system;

a power cable for connection to a power source for supplying power to said engine cleaning system;

a solution tank for holding a fluid;

a first hose and a second hose coupled to said solution tank, said first hose having an input connector for connection to an engine and said second hose having an output connector for connection to the engine;

a pump controlled by said microcomputer to cause fluid to flow from said solution tank through said first hose to said engine;

a regulating valve coupled to said first hose and said second hose for regulating a fluid pressure of the fluid being supplied to the engine by opening up said regulating valve and allowing at least a portion of the fluid to bypass said engine and to pass through said regulating valve to said tank via said second hose when the fluid pressure being supplied to the engine reaches a predetermined pressure;

a solenoid valve coupled to said first hose between said regulating valve coupling and said input connector, for enabling said engine cleaning system to trap fluid in the engine and measure changes in the fluid pressure in order to determine whether any leaks exist in the engine, said solenoid valve connected to a signal which causes said solenoid valve to close when said engine cleaning system is operating in a leak test mode; and a sensor which measures the fluid pressure is said first hose when said solenoid valve is closed, said sensor connected to said microprocessor to communicate fluid pressure information to said microprocessor.

2. The microcomputer controlled engine cleaning system of claim 1, further comprising an overpressure valve coupled to said first hose between said pump and said solenoid valve on a first end, and coupled to said second hose between said solution tank and said output connector on a second end, for providing a safety valve which opens up to allow fluid to pass through when the fluid pressure reaches a predetermined danger level, thereby lowering the fluid pressure below said predetermined danger level.

3. The microcomputer controlled engine cleaning system of claim 2, further comprising a low pressure switch coupled to said first hose between said solenoid valve and said input connector for indicating to said microcomputer when fluid pressure being supplied to the engine rises above a first predetermined minimum value, and when the fluid pressure being supplied to the engine drops below a second predetermined minimum value.

4. The microcomputer controlled engine cleaning system of claim 3, further comprising a gauge coupled to said first hose between said solenoid valve and said input connected for providing a visual indication of the fluid pressure being supplied to the engine, thereby enabling a user to manually adjust said regulating valve to provide a desired fluid pressure to the engine.

5. The microcomputer controlled engine cleaning system of claim 4, further comprising a filter coupled to said first hose being said solution tank and said pump for filtering particles from the fluid being supplied from said solution tank to the engine.

6. A microcomputer controlled engine cleaning system comprising:

a microcomputer which executes a program for controlling the operation of said engine cleaning system;

a power cable for connection to a power source for supplying power to said engine cleaning system;

a solution tank for holding a fluid;

a first hose and a second hose coupled to said solution tank;

said first hose having an input connector for connection to an engine;

said second hose having an output connector for connection to the engine;

a pump in electrical communication with said microcomputer and in fluid communication with said solution tank via said first hose, said pump being coupled to said first hose between said solution tank and said input connector;

a solenoid valve in electrical communication with said microcomputer and in fluid communication with said pump via said first hose, said solenoid valve being coupled to said first hose between said pump and said input connector;

a regulating valve in fluid communication with said first hose and said second hose, said regulating valve being coupled to said first hose between said pump and said solenoid valve on a first end, and coupled to said second hose between said solution tank and said output connector on a second end;

an overpressure valve in fluid communication with said first hose and said second hose, said overpressure valve being coupled to said first hose between said pump and said solenoid valve on a first end, and coupled to said second hose between said solution tank and said output connector on a second end to permit fluid to flow from said first hose to said second hose, bypassing the engine;

a low pressure switch in electrical communication with said microcomputer and in fluid communication with said first hose, said low pressure switch being coupled to said first hose between said solenoid valve and said input connector;

a gauge in fluid communication with said first hose, said gauge being coupled to said first hose between said solenoid valve and said input connector; and a filter in fluid communication with said solution tank via said first hose, said filter being coupled to said first hose between said solution tank and said pump.

7. The microcomputer controlled engine cleaning system of claim 6, further comprising an electrical timer selectively set to a predetermined time duration for a given operating mode by said microcomputer.

8. The microcomputer controlled engine cleaning system of claim 6, further comprising an electric timer selectively set to a predetermined time duration for a given operating mode by a user.

9. The microcomputer controlled engine cleaning system of claim 6, wherein said power cable is coupled to a reverse polarity protection circuit for assuring proper application of power source polarity.

10. The microcomputer controlled engine cleaning system of claim 6, further comprising:

a tank level monitor and a display, said tank level monitor in electrical communication with said microcomputer and in communication with said solution tank for monitoring a level of fluid in said solution tank, said display in electrical communication with said microcomputer for displaying a visual indication of said level of fluid in said solution tank.

11. The microcomputer controlled engine cleaning system of claim 6, further comprising a current monitor in electrical communication with said microcomputer and providing current readings to said microcomputer in order to notify said microcomputer when fluid pressure exceeds a predetermined current level by correlating a current value with said predetermined current level and shutting down said pump.

12. The microcomputer controlled engine cleaning system of claim 6, wherein said microcomputer automatically turns off said pump from an autopurge mode when a predetermined condition is met.

13. The microcomputer controlled engine cleaning system of claim 12, wherein said predetermined condition is when four seconds have expired.

14. The microcomputer controlled engine cleaning system of claim 12, wherein said predetermined condition is when fluid pressure drops below two pounds per square inch.

15. The microcomputer controlled engine cleaning system of claim 6, wherein said low pressure valve sends a signal to said microcomputer when a fluid pressure of the fluid being supplied to the engine drops below two pounds per square inch.

16. The microcomputer controlled engine cleaning system of claim 6, wherein said low pressure valve sends a signal to said microcomputer when a fluid pressure of the fluid being supplied to the engine rises above four pounds per square inch.

17. The microcomputer controlled engine cleaning system of claim 6, wherein said microcomputer is programmed to provide gradual power to said pump at start up thereby providing time to detect leaks prior to reaching full operating pressure.

18. A method of operating a processor-controlled engine cleaning system comprising the steps of:

operating a fluid pump coupled by a hose to a solvent container to pump solvent into an engine;

monitoring a current used to power said pump to detect when said current reaches a first current level;

halting the operation of said pump when said current exceeds said first current level;

pumping fluid into the engine at a fluid pressure below the required operating fluid pressure of the engine thereby ensuring that fluid does not exit the engine;

closing a solenoid valve positioned between said pump and the engine to trap the fluid in the engine;

turning off said pump;

waiting for a first time duration; and determining whether a leak exists in the engine based upon whether the fluid pressure has dropped during the first time duration.

19. The method of operating a processor-controlled engine cleaning system as defined in claim 18, further comprising the step of opening a pressure valve in response to pressure in said hose reaching a second pressure level.

20. The method of operating a processor-controlled, engine cleaning system as defined in claim 18, further comprising the step of purging said first hose upon the occurrence of a predetermined condition.

* * * * *

UNITED STATES PATENT AND TRADEMARK OFFICE

CERTIFICATE OF CORRECTION

PATENT NO. : 5,845,225

DATED : December 1, 1998

INVENTOR(S) : Frederick A. Mosher

It is certified that error appears in the above-identified patent and that said Letters Patent is hereby corrected as shown below:

In Column 13, Line 37, change "being" to --between--.

Signed and Sealed this

Twenty-seventh Day of July, 1999

*Attest:*

Q. TODD DICKINSON

*Attesting Officer*

*Acting Commissioner of Patents and Trademarks*